US006688951B2

(12) United States Patent
Kashiwaya et al.

(10) Patent No.: US 6,688,951 B2
(45) Date of Patent: Feb. 10, 2004

(54) THERMAL HEAD LAPPING APPARATUS

(75) Inventors: Makoto Kashiwaya, Kanagawa (JP); Junji Nakada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/534,555

(22) Filed: Mar. 27, 2000

(65) Prior Publication Data

US 2003/0060146 A1 Mar. 27, 2003

(30) Foreign Application Priority Data

Mar. 26, 1999 (JP) ..... 11-083915

(51) Int. Cl.[7] ..... B24B 7/00
(52) U.S. Cl. ..... 451/168; 451/296
(58) Field of Search ..... 451/168, 166, 451/169, 296, 303, 304, 305, 313

(56) References Cited

U.S. PATENT DOCUMENTS 5,065,547 A * 11/1991 Shimizu et al. ..... 51/154
5,443,415 A * 8/1995 Shebanow et al. ..... 451/302
5,569,063 A * 10/1996 Morioka et al. ..... 451/296
5,584,752 A * 12/1996 Mizutani ..... 451/296
5,951,384 A * 9/1999 Morioka et al. ..... 451/303

FOREIGN PATENT DOCUMENTS

JP 7-132628 5/1995
JP 11-5323 1/1999

OTHER PUBLICATIONS

Patent Abstract of Japan 07132628 A Nov. 10, 1993.
Patent Abstract of Japan 11005323 A Apr. 22, 1997.

* cited by examiner

*Primary Examiner*—Dung Van Nguyen
(74) *Attorney, Agent, or Firm*—Sughrue Mion, PLLC

(57) ABSTRACT

A thermal head lapping apparatus includes a pallet for holding at least one thermal head, a transport device for transporting the thermal head held on the pallet successively to a specified processing position, and a lapping device for forcing a lapping material being moved onto the thermal head that has been transported to said processing position. As a result, the apparatus is capable of advantageously performing lapping treatment with a good efficiency on surfaces to be coated with protective layers or the formed protective layers in a process of fabricating a thermal head, thereby improving the production efficiency of the thermal head and fabricating with a good productivity the suitably lapped thermal head of high quality that ensures high quality image recording.

20 Claims, 4 Drawing Sheets

THERMAL HEAD LAPPING APPARATUS

BACKGROUND OF THE INVENTION

This invention relates to the art of fabricating thermal heads for thermal recording which are used in various types of printers, plotters, facsimile, recorders and the like as a recording device. More specifically, the invention relates to a thermal head lapping apparatus that is used to lap (polish) protective layers or layers to be coated therewith on a thermal head in the process of fabricating the thermal head.

Thermal materials comprising a thermal recording layer on a substrate of a film or the like are used to record images produced in diagnosis by ultrasonic scanning (sonography).

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze, in which heating elements comprising a heat-generating resistor and electrodes are arranged in one direction (main scanning direction) and, with the glaze urged at small pressure against a thermal material, the two members are moved relative to each other in an auxiliary scanning direction perpendicular to the main scanning direction, and energy is applied to the respective heating elements of the glaze in accordance with image data to be recorded which were supplied from an image data supply source such as MRI or CT in order to heat the thermal recording layer of the thermal material, thereby performing image recording through color formation.

A protective coating is formed on the surface of the glaze of the thermal head in order to protect the heat-generating resistor for heating the thermal material, the associated electrodes and the like. Therefore, it is this protective coating that contacts the thermal material during thermal recording and the heat-generating resistor heats the thermal material through this protective coating so as to perform thermal recording.

The protective coating is usually made of wear-resistant ceramics such as silicon nitride; however, during thermal recording, the surface of the protective coating is heated and kept in sliding contact with the thermal material, so it will gradually wear and deteriorate upon repeated recording.

If the wear of the protective coating progresses, density unevenness will occur on the thermal image or a desired protective strength can not be maintained and, hence, the ability of the protective coating to protect the heat-generating resistor is impaired to such an extent that the intended image recording is no longer possible (the head has lost its function).

Particularly in the applications such as the aforementioned medical use which require multiple gradation images of high quality, the trend is toward ensuring the desired high image quality by adopting thermal films with highly rigid substrates such as polyester films and also increasing the setting values of recording temperature (energy applied) and of the pressure at which the thermal head is urged against the thermal material. Under these circumstances, as compared with the conventional thermal recording, a greater force and more heat are exerted on the protective coating of the thermal head, making wear and corrosion (or wear due to corrosion) more likely to progress.

With a view to preventing the wear of the protective coating on the thermal head and improving its durability, a number of techniques have been considered. In an example, it is considered to use the ceramic protective layer described above in combination with a carbon-based protective layer (hereinafter referred to as a "carbon protective layer"). The carbon protective layer has properties quite similar to those of diamond including a very high hardness and chemical stability, hence the carbon protective layer presents sufficiently excellent properties to prevent wear and corrosion which may be caused by sliding contact with thermal materials.

Unexamined Published Japanese Patent Application (KOKAI) No. 7-132628 discloses a thermal head which has a dual protective coating comprising a lower silicon-based compound layer and an overlying diamond-like carbon layer, said protective coating having wear and breakage significantly reduced, thereby ensuring that high-quality images can be recorded over an extended period of time.

In the process of fabricating the thermal head, the protective layers are very often subjected to lapping treatment (polishing treatment) for the purpose of improving the surface properties and the adhesion of the protective layers and preventing the image deterioration and the damage of the thermal material.

The irregularities on the surface to be coated with the carbon protective layer described above are easily reflected thereon. Then, if the surface to be coated has irregularities, they are formed on the surface of the carbon protective layer, which would be a cause of image deterioration. The carbon protective layer is also brittle because of its hardness. Then, if the surface to be coated has irregularities or a foreign matter, delamination or cracking develops easily due to a mechanical or physical stress. If the carbon protective layer is formed after the surface of the underlying protective layer to be coated is smoothed by lapping treatment, the surface properties and the adhesion of the carbon protective layer are improved, so that image deterioration, cracking and delamination due to the irregularities on the surface can be effectively prevented (Unexamined Published Japanese Patent Application (KOKAI) No. 11-5323).

SUMMARY OF THE INVENTION

An object of the present invention is to provide a thermal head lapping apparatus that is capable of advantageously performing lapping treatment with a good efficiency on surfaces to be coated with protective layers or the formed protective layers in a process of fabricating a thermal head, thereby improving the production efficiency of the thermal head and fabricating with a good productivity the suitably lapped thermal head of high quality that ensures high quality image recording.

In order to achieve the above object, the invention provides a thermal head lapping apparatus comprising:

- a pallet for holding at least one thermal head;
- a transport device for transporting the thermal head held on the pallet successively to a specified processing position; and
- a lapping device for forcing a lapping material being moved onto the thermal head that has been transported to said processing position.

In a preferred embodiment, said transport device moves the pallet in a direction in which heating elements of the thermal head are arranged while said lapping device forces the lapping material being moved onto the thermal head, so that the thermal head is lapped.

In another preferred embodiment, said pallet holds a plurality of thermal heads arranged in a direction perpendicular to a direction in which heating elements of each of the thermal heads are arranged; said lapping device uses the lapping material that has a width covering a whole area of the heating elements of each of the thermal heads; and said transport device transports the pallet discontinuously in the direction in which the thermal heads are arranged so that the thermal heads held on the pallet are successively transported to said processing position.

DETAILED DESCRIPTION OF THE INVENTION

The thermal head lapping apparatus of the invention will now be described in detail with reference to the preferred embodiments shown in the accompanying drawings.

Figure 1:
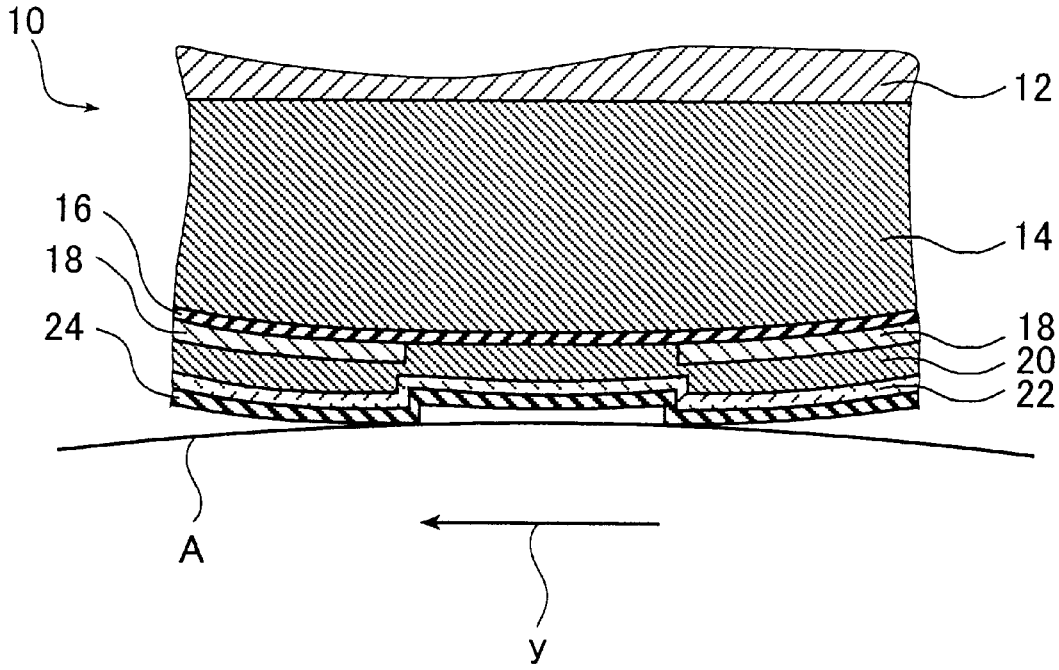
FIG. 1 is a schematic cross sectional view showing the structure of a heating element in a preferred thermal head fabricated using the thermal head lapping apparatus of the present invention.

FIG. 1 shows a schematic cross sectional view of a heating element of a preferred thermal head fabricated using the thermal head lapping apparatus (hereinafter referred to as a "lapping apparatus") of the invention.

The thermal head 10 shown in FIG. 1 is capable of image recording on thermal sheets of up to, for example, B4 size at a recording (pixel) density of, say, about 300 dpi. Except for the protective coating, the head has a known glaze structure in that heating elements performing thermal recording on a thermal material A are arranged in one direction (which is normal to the plane in FIG. 1).

As shown in FIG. 1, the thermal head 10 comprises a glaze layer (heat-accumulating layer) 14 formed on the top of a substrate 12 (which is shown to face down in FIG. 1 since the thermal head 10 is pressed downward against the thermal material A), a heater (heat-generating resistor) 16 formed on the glaze layer 14, electrodes 18 formed on the heater 16, and a protective coating formed on the heater 16 and the electrodes 18.

The protective coating in the thermal head 10 is composed of three layers: a lower protective layer 20 superposed on the heater 16 and the electrodes 18, an intermediate protective layer (hereinafter referred to as an "intermediate layer") 22 formed on the lower protective layer 20 and a carbon-based protective layer (hereinafter referred to as a "carbon protective layer") 24 which is formed on the intermediate layer 22.

The lapping apparatus of the invention can be used with advantage in all steps of the lapping treatment (hereinafter referred to as an "polishing treatment") in the process of fabricating known versions of thermal heads, particularly in the polishing treatment of protective layers or surfaces to be coated therewith.

Therefore, the illustrated thermal head 10 has essentially the same structure as known versions of thermal head, except for the characteristic layer arrangement of the protective coating. Specifically, the substrate 12 may be formed of various electrical insulating materials including heat-resistant glass and ceramics such as alumina, silica and magnesia; the glaze layer 14 may be formed of heat-resistant glass, heat resistant resins including polyimide resin and the like; the heater 16 may be formed of heat-generating resistors such as Nichrome (Ni—Cr), tantalum metal and tantalum nitride; and the electrodes 18 may be formed of electrically conductive materials such as aluminum, gold, silver and copper.

Heating elements on the glaze are known to be available usually in two types, one being of a thin-film type which is formed by a "thin-film" process such as vacuum deposition, chemical vapor deposition (CVD) or sputtering and a photoetching technique, and the other being of a thick-film type which is formed by a "thick-film" process comprising the steps of printing (e.g., screen printing) and firing. The thermal head 10 for use in the invention may be formed by either method.

The lower protective layer 20 formed on the thermal head 10 may be formed of various known materials as long as they have sufficient heat resistance, corrosion resistance and wear resistance to be used in the protective coating of the thermal head. Various ceramic materials including silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SO_2$) are preferably used.

The illustrated thermal head 10 has a protective coating of three-layer structure, in which the lower protective layer 20 as described above is coated with the intermediate layer 22 which is, in turn, coated with the carbon protective layer 24.

As described above, the carbon protective layer 24 has chemically high stability. Then, by providing the carbon protective layer 24 on the lower protective layer 20, the lower protective layer 20, the heater 16, the electrodes 18 and the like can be effectively protected from chemical corrosion, thereby prolonging the service life of the thermal head. If the intermediate layer 22 is further inserted therebetween, the adhesion of the lower protective layer 20 to the carbon protective layer 24 and the shock absorption can be improved, thereby providing a thermal head with prolonged service life and which is more excellent in durability and long term reliability.

The intermediate layer 22 formed on the thermal head 10 is preferably based on at least one component selected from the group consisting of metals in Group IVA (titanium group), Group VA (vanadium group) and Group VIA (chromium group) of the periodic table, as well as silicon (Si) and germanium (Ge) in such aspects as the adhesion to the upper carbon protective layer 24 and the lower protective layer 20 and the durability of the carbon protective layer 24. In particular, Si and Mo are more preferably used in the binding with the carbon protective layer 24 and other aspects. Most preferably, Si is used.

In the illustrated thermal head 10, the carbon-based protective layer 24 is formed on the intermediate layer 22.

It should be noted that the carbon-based protective layer 24 as used in the present invention refers to a carbon layer containing not less than 50 atm % of carbon, and preferably comprising carbon and inevitable impurities.

Suitable components to be incorporated in addition to carbon to form the carbon protective layer 24 include hydrogen, nitrogen, fluorine, Si and Ti. In the case of hydrogen, nitrogen and fluorine, the content thereof in the carbon protective layer 24 is preferably less than 50 atm %, and in the case of Si and Ti, the content thereof in the carbon protective layer 24 is preferably not more than 20 atm %.

In the process of fabricating the thermal head as described above, the lapping apparatus of the invention performs polishing treatment on the formed protective layers or the surfaces to be coated therewith before the respective protective layers are formed.

In the case of the illustrated thermal head 10 (which may be of two-layered structure excluding the intermediate layer 22), the lower protective layer 20 is preferably polished to the surface roughness Ra of from 0.005 $\mu$m to 0.5 $\mu$m prior to forming the intermediate layer 22 and the carbon protective layer 24.

In this case, not only the image deterioration due to the irregularities on the carbon protective layer 24 is prevented, but also the adhesion of the lower protective layer 20 to the carbon protective layer 24 and the intermediate layer 22 is improved, whereby a thermal head that is protected from delamination and cracking of the protective layers and that has higher durability and reliability can be realized. Proper treatment of the surface of the lower protective layer 20 suffices for the intermediate layer 22, because the surface roughness thereof follows approximately that of the lower protective layer 20.

Whether the protective coating is of two-layered structure or three-layered structure, the carbon protective layer 24 is preferably polished to the surface roughness Ra of from 2 nm to 100 nm after it is formed.

This example can provide a thermal head that has little sticking, hence has significantly reduced recording noise or washed-out highlights of image due to sticking.

Figure 2:
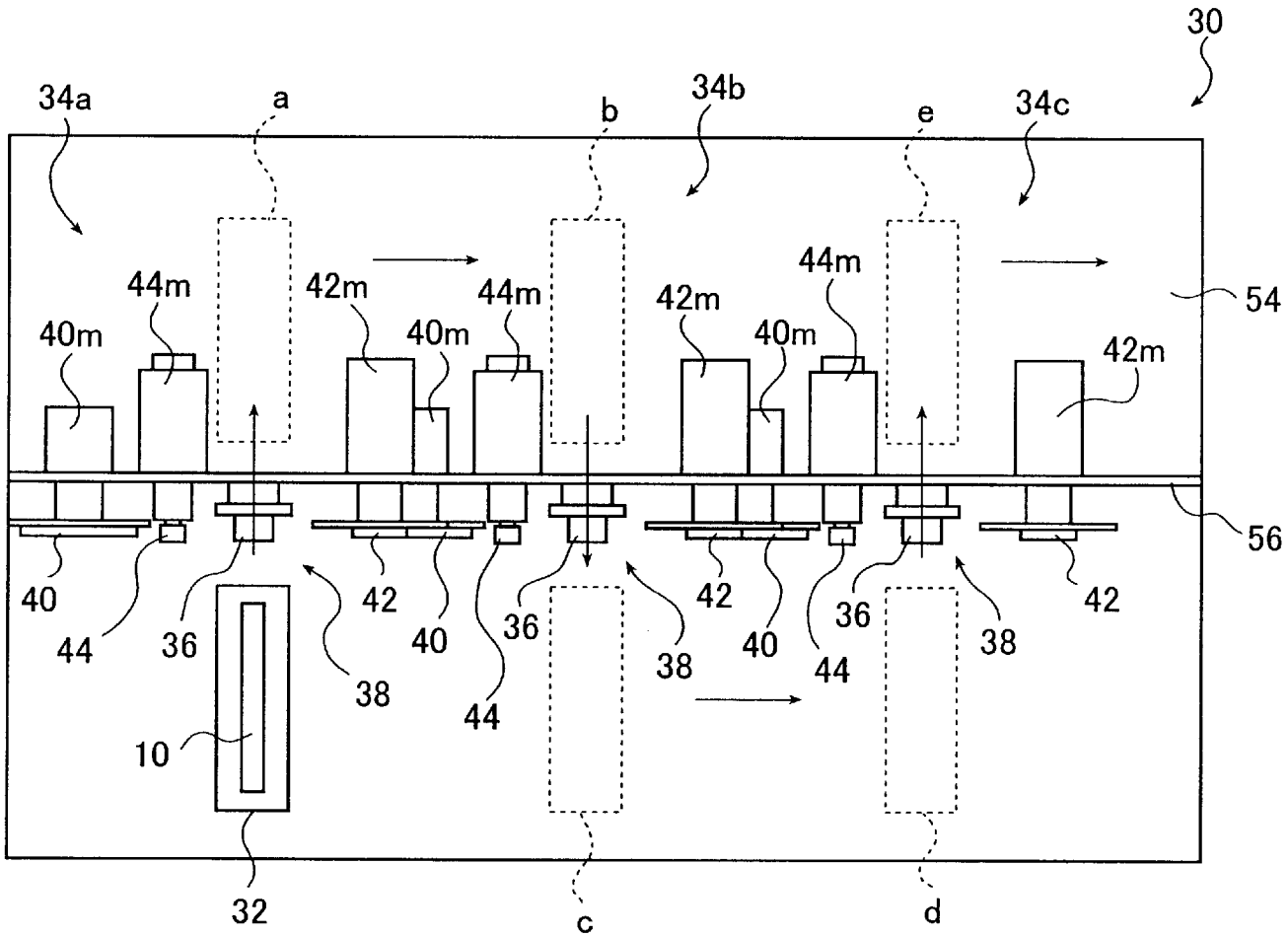
FIG. 2 is a schematic plan view showing an embodiment of the thermal head lapping apparatus of the present invention.
Figure 3:
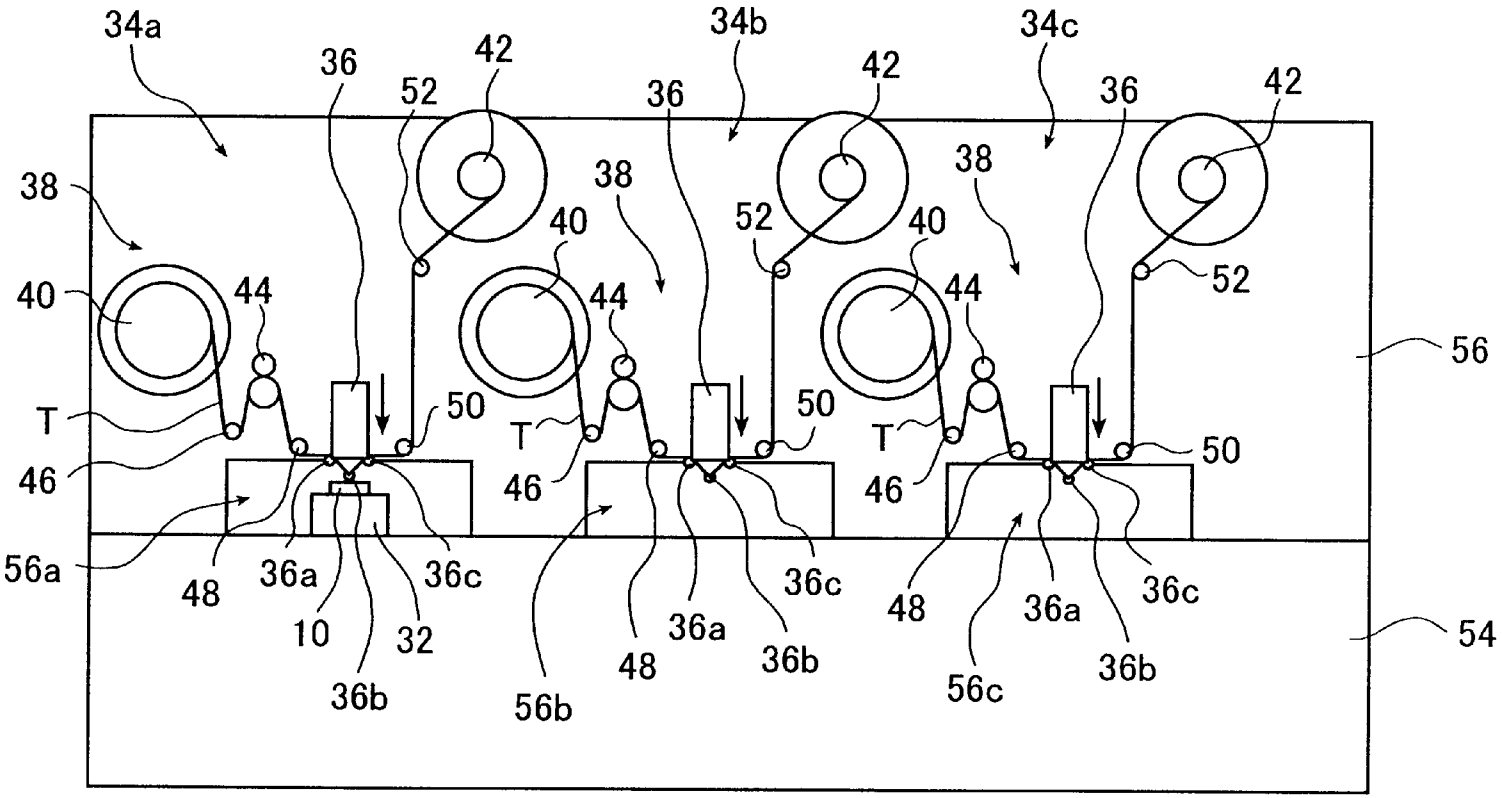
FIG. 3 is a schematic front view of the thermal head lapping apparatus shown in FIG. 2.

FIGS. 2 and 3 show a plan view and a front view of an embodiment of the lapping apparatus of the invention, respectively. A lapping tape is not shown in FIG. 2 for the sake of clarification of the apparatus layout.

The illustrated lapping apparatus 30 is used to perform polishing treatment on the glaze of the thermal head. The apparatus 30 comprises a pallet 32 for receiving and holding a thermal head 10; a transport device (not shown) for transporting the pallet 32 along a specified path including a position corresponding to the processing position in which the polishing treatment of the thermal head 10 is performed; and three polishing sections including a first polishing section (lapping section) 34*a* that performs the polishing treatment with a lapping tape T (hereinafter referred to as a "tape T") of #4000, a second polishing section 34*b* that performs the polishing treatment with a tape T of #8000, and a third polishing section 34*c* that performs the polishing treatment with a tape T of #20000.

In the illustrated case, the respective polishing sections have basically the same layout. Then, like members are denoted by like references. The first polishing section 34*a* is now described below as a typical example.

The lapping apparatus of the invention is not limited to the one that has three polishing sections, and may be provided with one or two sections. Alternatively, the lapping apparatus may comprise more than three polishing sections.

The count of the tape T also is not limited to the above case. The count of the lapping material to be used in the lapping apparatus of the invention is not particularly limitative, and can be appropriately selected in accordance with the material of the member to be polished and the amount of polishing. The count is preferably in the range of from about #1000 to about #20000, more preferably from #4000 to #20000.

The first polishing section 34*a* (second polishing section 34*b* or third polishing section 34*c*) comprises basically a forcing unit 36 and a unit 38 for moving the tape T.

Three guide rollers 36*a*, 36*b* and 36*c* for guiding the tape T are provided under the forcing unit 36 in a reversed triangle shape.

The forcing unit 36 has a vertically moving device (not shown) and is normally moved upward. When the pallet 32 holding the thermal head 10 is transported to a specified position, the vertically moving device moves downward the forcing unit 36, which forces the tape T onto the thermal head 10 in the processing position.

In the embodiment shown in FIGS. 2 and 3, the forcing unit 36 moves vertically. Therefore, the processing position is under the guide roller 36*b*.

The device for moving the forcing unit 36 vertically is not limited to any particular type, and various known devices including a device using a spring, a device using its weight, device using various cylinders, device using a cam and combinations thereof are available.

The pressure at which the tape T is forced onto the thermal head 10 is not limited to any particular value, and can be appropriately determined in accordance with the type of the material to be polished, the amount of polishing and other factors. Thus, when polishing the lower protective layer 20, the intermediate layer 22, the carbon protective layer 24 and the like, the pressure is preferably in the range of from 0.1 g/mm$^2$ to 500 g/mm$^2$.

The unit 38 for moving the lapping tape comprises a feed roller 40 of the tape T, a take-up roller 42 of the tape T, a moving roller pair 44 and guide rollers 46, 48, 50 and 52.

The feed roller 40, the moving roller pair 44 and the take-up roller 42 are engaged with a motor 40*m*, a servo motor 44*m* and a motor 42*m*, respectively, and these motors rotate the corresponding rollers in accordance with the feed speed of the tape T. Further, these rollers are adapted to be rotatable in the reverse direction.

These respective members are supported by a support plate 56 fixed at right angles with a base 54. Further, openings 56*a*, 56*b* and 56*c* through which the pallet 32 passes are formed in the support plate 56.

In the illustrated case, the tape T is a narrow elongated ribbon, and is at first wound on the feed roller 40. It should be noted that the width of the tape T is not particularly limitative and is in the range of from about ¼ in. to about 1 in.

The tape T fed from the feed roller 40 is transported through the guide roller 46 to the moving roller pair 44, by which it is pinched and further transported through the guide roller 48 to reach the guide rollers 36*a*, 36*b* and 36*c* of the forcing unit 36. After having come in contact with the lower surface of the guide roller 36*b*, the tape T is further moved upward through the guide rollers 50, 52 to be wound on the take-up roller 42. Namely, the tape T is moved from the feed roller 40 to the take-up roller 42 in the transverse direction shown in FIG. 3.

If the tape T entirely fed from the feed roller 40 can be reused, it is moved in the reverse direction so as to return from the take-up roller 42 to the feed roller 40, during which polishing treatment is performed.

The feed speed of the tape T is not limited to any particular value and can be appropriately determined in accordance with the type of the material to be polished, the amount of polishing or other factors. Thus, the feed speed of from 0.1 m/sec to 50 m/sec is preferred when polishing the lower protective layer 20, the intermediate layer 22, the carbon protective layer 24 and the like.

The transport device moves the pallet 32 holding the thermal head 10 along the specified path including the processing position as shown by arrows in FIG. 2.

The device for transporting the pallet in the lapping apparatus of the invention is not limited to any particular type, and various known devices for transporting plate members can be used. Various known methods including a method in which the pallet is moved on a linear motion ("LM") guide by motor revolution can be used.

The transport speed of the pallet (thermal head) during polishing treatment can be appropriately determined in accordance with the feed speed of the tape T, the hardness of the material to be polished, the amount of polishing and the like.

In the illustrated lapping apparatus 30, the pallet 32 holding the thermal head 10 is loaded in a specified position (shown by solid lines) corresponding to the first polishing section 34*a*.

When it is confirmed that the feed speed of the tape T moved by the moving unit 38 is a specified value, the pallet 32 is transported by the transport device as shown by an arrow in FIG. 2 in the direction (upward direction in FIG. 2 and rearward direction in FIG. 3) perpendicular to the direction in which the tape T is moved, with the direction in which the glaze of the thermal head 10 extends (or the heating elements are arranged) being in agreement with the direction of transport of the pallet 32. The pallet 32 reaches the position shown by "a" in FIG. 2 after having been moved under the forcing unit 36 (guide roller 36*b*).

During the transport, the thermal head 10 (or the glaze) passes through the processing position of the first polishing section 34*a*. When the pallet 32 is transported to the specified position, the forcing unit 36 descends to force the tape T being moved onto the glaze of the thermal head 10, which is polished with the tape T of #4000, while being transported in the direction perpendicular to the direction in which the tape T is moved.

Then, the pallet 32 is moved in the right direction in FIG. 2 to reach the corresponding position of the second polishing section 34*b* shown by "b" in FIG. 2, from which the pallet 32 is further transported in the direction (downward direction in FIG. 2) that is reverse to the transport for the treatment in the first polishing section 34*a* and that is perpendicular to the direction of transport of the tape T. Thus, the pallet 32 reaches the position shown by "c" in FIG. 2. During the transport, the thermal head 10 is also polished in the processing position of the second polishing section 34*b* with the tape T of #8000.

The pallet 32 is further moved again in the right direction to reach the corresponding position of the third polishing section 34*c* shown by "d" in FIG. 2. From this position, the pallet 32 is transported in the direction (upward direction FIG. 2.) that is reverse to the previous transport for the treatment in the second polishing section 34*b* and that is perpendicular to the direction of transport of the tape T. Thus, the pallet 32 reaches the position show by "e" in FIG. 2. During the transport, the thermal head 10 is also polished in the processing position of the third polishing section 34*c* with the tape T of #20000. Thus, the polishing treatment is finished.

After the end of the polishing treatment, the pallet 32 holding the thermal head 10 is transported from the position "e" to a specified ejecting position, through which the thermal head 10 is ejected from the lapping apparatus 30.

In the lapping apparatus 30 described above, the number of the thermal head (or the pallet 32) to be supplied into the apparatus 30 is not limited to one, but a plurality of pallets 32 for holding the thermal heads 10 may be supplied into the apparatus 30 so that the polishing treatment is, for example, simultaneously performed in the first, second and third polishing sections 34*a*, 34*b* and 34*c*. In this case, one or more pallets 32 may stand by for the treatment in the positions shown by "a"–"d".

In the embodiment shown in FIGS. 2 and 3, the pallet 32 is transported in a zigzag-like manner to transport the thermal head 10 to the respective polishing sections successively. However, this is not the sole case of the invention, and in an example, the pallet 32 may be transported linearly to transport the thermal head 10 successively to the respective polishing sections 34*a*–34*c* that are linearly provided in the direction in which the pallet 32 is transported for polishing.

The direction in which the pallet (or thermal head) is transported with respect to the direction of transport of the tape T is not limited to the one that is perpendicular to the latter, and the thermal head may be transported, for example, in the same direction as or in the reverse direction to the direction in which the tape T is moved.

These may be appropriately selected and set in accordance with such factors as layout of the apparatus, site where the apparatus is placed, size of the apparatus, width of the lapping tape, length and width of the glaze, and so forth.

In the above embodiment, polishing treatment is performed using a narrow tape as the tape T, while a thermal head held on the pallet is transported in the direction in which the glaze extends. However, the present invention is not limited to this embodiment, and a plurality of thermal heads may be held on a pallet.

Further, the thermal head may be fixed to polish the whole area of the glaze at a time using a wide lapping film.

Figure 4A:
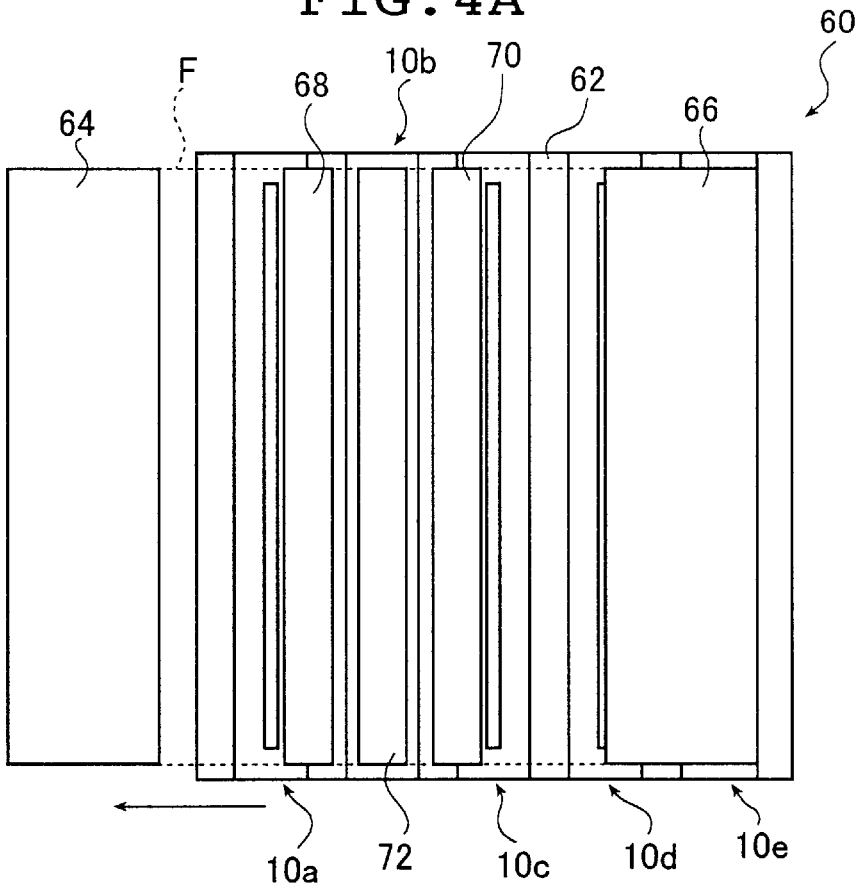
FIGS. 4A and 4B show a schematic plan view and a schematic front view of another embodiment of the thermal head lapping apparatus of the present invention.
Figure 4B:
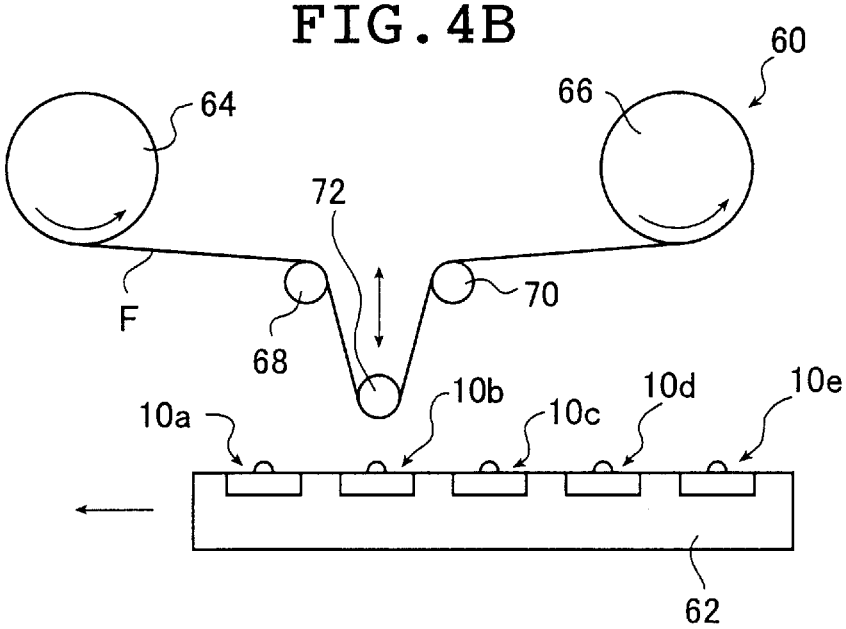

This embodiment is shown in FIGS. 4A and 4B, which are a plan view and a front view, respectively. In order to clarify the layout of the apparatus, the lapping film is shown by dotted lines in FIG. 4A.

The illustrated lapping apparatus 60 uses as a lapping material a lapping film F (hereinafter referred to as a "film F") that covers the whole area of the glaze of the thermal head 10*a*, 10*b*, 10*c*, 10*d* or 10*e* to be polished. It comprises basically a pallet 62 for receiving and holding up to five thermal heads 10*a*, 10*b*, 10*c*, 10*d*, 10*e*, a transport device (which is schematically shown in FIG. 4B as a linear motion guide 100) of the pallet 62, and a polishing device including a feed roller 64, a take-up roller 66, guide rollers 68 and 70, and a forcing roller 72.

In this lapping apparatus 60, the film F is wound on the feed roller 64. The film F is fed from the feed roller 64 and guided by the guide roller 68 to reach the forcing roller 72, by which it is further guided upward while being held in contact with the lower surface thereof. The film F is wound up on the take-up roller 66 after having been guided by the guide roller 70. Thus, the film F is moved in the transverse direction in FIG. 4B.

Further, the forcing roller 72 is adapted to move vertically by a known device, as in the forcing unit 36 of the lapping apparatus 30 as mentioned above.

Also in this embodiment, if the film F that has been entirely fed from the feed roller 64 can be reused, it is moved in the reverse direction to perform lapping treatment.

The pallet 62 holds five thermal heads 10*a*, 10*b*, 10*c*, 10*d* and 10*e*, which are placed in the direction perpendicular to the direction in which the glaze extends.

The pallet 62 is transported discontinuously by the transport device in the direction in which the thermal heads 10*a*–10*e* are arranged, so that each of the thermal heads 10*a*–10*e* is transported to a specified processing position. It should be noted here that all known transport methods can be used.

When the pallet 62 holding the thermal heads 10*a*–10*e* is loaded in a specified position in the illustrated lapping apparatus, transport is made by the transport device and is stopped when the top thermal head 10*a* in the transport direction reaches the specified processing position or when the glaze thereof comes under the forcing roller 72. At that time, the forcing roller 72 is in UP position.

When it is confirmed that the thermal head 10*a* is in the specified position and that the film F moves at a specified speed, the forcing roller 72 descends to force the film F onto the glaze of the thermal head 10*a*, so that the thermal head 10*a* is polished.

When the thermal head 10*a* has been polished, the forcing roller 72 ascends, and the pallet 62 is transported again by the transport device and stopped at the time the next thermal head 10*b* reaches the processing position as shown in FIG. 4. When the position of the thermal head 10*b* is confirmed, the forcing roller 72 redescends to polish the thermal head 10*b*.

After the end of this polishing treatment, the forcing roller 72 reascends and the next thermal head 10*c* is transported to the processing position for polishing treatment in the same manner. Further, polishing treatment of the thermal heads 10*d* and 10*e* is performed in the same manner.

When the polishing treatment of all the thermal heads 10*a*–10*e* is finished, the pallet 62 is transported by the transport device to the next step or out of the lapping apparatus 60.

The lapping apparatus 60 shown in FIG. 4 has only one polishing section, but a plurality of polishing sections may be arranged as in the above-mentioned embodiment shown in FIGS. 2 and 3 so that the pallet 62 is successively transported to other polishing sections for polishing treatment after all the thermal heads 10*a*–10*e* held thereon have been polished.

On the foregoing pages, the thermal head lapping apparatus of the invention has been described in detail but the present invention is in no way limited to the stated embodiments and various improvements and modifications can of course be made without departing from the spirit and scope of the invention.

For example, a plurality of thermal heads may be held on a pallet in the embodiment that performs polishing treatment while moving the thermal head, as shown in FIGS. 2 and 3. Alternatively, only one thermal head may be held on a pallet in the embodiment that uses the wide lapping film as shown in FIG. 4.

As described above in detail, the present invention is capable of advantageously performing lapping treatment with a good efficiency on the carbon protective layer or the surface to be coated therewith, said treatment being significantly effective for fabricating a high-quality thermal head. The production efficiency of the thermal head can be thus improved to fabricate with a good productivity the suitably lapped thermal head that ensures high quality image recording.

What is claimed is:

1. A thermal head lapping apparatus, comprising:

a pallet holding at least one thermal head that has heating elements;

a transport device transporting the thermal head held on the pallet to a specified processing position; and a lapping device for forcing a lapping material being moved onto the thermal head that has been transported to said processing position, wherein the pallet and the thermal head move together to said processing position.

2. The thermal head lapping apparatus according to claim 1, wherein said transport device moves the pallet in a direction in which the heating elements of the thermal head are arranged while said lapping device forces the lapping material being moved onto the thermal head, so that the thermal head is lapped.

3. The thermal head lapping apparatus according to claim 1, wherein said lapping device comprises of at least one polishing section.

4. The thermal head lapping apparatus according to claim 3, wherein said at least one polishing section uses said lapping material that has a width covering a whole area of the heating elements of the thermal head.

5. The thermal head lapping apparatus according to claim 4, wherein said lapping material further comprises of a lapping tape, the count of the lapping tape varies in the range of #1000 to #20000.

6. The thermal head lapping apparatus according to claim 5, wherein said at least one polishing section further comprises of a forcing unit and moving unit, said forcing unit forces said lapping tape onto the thermal head, and said moving unit moves said lapping tape.

7. The thermal head lapping apparatus according to claim 6, wherein said moving unit comprises of a feed roller, a take-up roller, a moving roller pair, and guide rollers, said feed roller, moving roller pair, take-up roller are engaged with a motor, a servo motor, and a motor respectively.

8. The thermal head lapping apparatus according to claim 6, wherein said forcing unit comprises a moving device.

9. The thermal head lapping apparatus according to claim 1, wherein said transport device comprises a linear motion guide.

10. A thermal head lapping apparatus, comprising:

a pallet for holding at least one thermal head;

a transport device for transporting the thermal head held on the pallet to a specified processing position; and a lapping device for forcing a lapping material being moved onto the thermal head that has been transported to said processing position, wherein said pallet holds a plurality of thermal heads arranged in a direction perpendicular to a direction in which heating elements of each of the thermal heads are arranged; said lapping device uses the lapping material that has a width covering a whole area of the heating elements of each of the thermal heads; and said transport device transports the pallet discontinuously in the direction in which the thermal heads are arranged so that the thermal heads held on the pallet are successively transported to said processing position.

11. A thermal head lapping apparatus, comprising:

a plurality of pallets holding a plurality of thermal heads, each of the thermal heads having heating elements;

a transport device transporting the thermal heads held on said plurality of pallets successively to a specified processing position; and a lapping device for forcing a lapping material being moved onto the thermal heads that have been transported to said processing position, wherein each pallet moves together with the thermal head held thereby to said processing position.

12. The thermal head lapping apparatus according to claim 11, wherein said lapping device comprises of at least one polishing section.

13. The thermal head lapping apparatus according to claim 12, wherein said at least one polishing section uses said lapping material that has a width covering a whole area of the heating elements of the thermal head.

14. The thermal head lapping apparatus according to claim 13, wherein said lapping material further comprises of a lapping tape, the count of the lapping tape varies in the range of #1000 to #20000.

15. The thermal head lapping apparatus according to claim 14, wherein said at least one polishing section further comprises of a forcing unit and moving unit, said forcing unit forces said lapping tape onto the thermal head, and said moving unit moves said lapping tape.

16. The thermal head lapping apparatus according to claim 15, wherein said moving unit comprises of a feed roller, a take-up roller, a moving roller pair, and guide rollers, said feed roller, moving roller pair, take-up roller are engaged with a motor, a servo motor, and a motor respectively.

17. The thermal head lapping apparatus according to claim 16, wherein said forcing unit comprises a moving device.

18. The thermal head lapping apparatus according to claim 11, wherein said transport device comprises a linear motion guide.

19. A thermal head lapping apparatus, comprising:

a plurality of pallets for holding a plurality of thermal heads;

a transport device for transporting the thermal heads held on said plurality of pallets successively to a specified processing position; and a lapping device for forcing a lapping material being moved onto the thermal heads that have been transported to said processing position, wherein said transport device moves said plurality of pallets in a direction in which heating elements of said plurality of thermal heads are arranged while said lapping device forces.

20. The thermal head lapping apparatus according to claim 1, wherein said lapping device comprises a plurality of polishing sections and wherein the lapping material is moved onto the thermal heads in each of said polishing section.

* * * * *